United States Patent [19]

Harper

[11] 4,278,914

[45] Jul. 14, 1981

[54] DIAMOND SUPPORTED HELIX ASSEMBLY AND METHOD

[75] Inventor: Robert Harper, Concord, Mass.

[73] Assignee: The United States of America as represented by the Secretary of the Navy, Washington, D.C.

[21] Appl. No.: 86,213

[22] Filed: Oct. 18, 1979

[51] Int. Cl.[3] ..... H01J 25/34

[52] U.S. Cl. ..... 315/3.5; 315/3.6; 315/39.3; 29/25.1; 29/600

[58] Field of Search ..... 315/3.5, 3.6, 39.3; 29/25.1, 600

[56] References Cited

U.S. PATENT DOCUMENTS

| | | | |
|---|---|---|---|
| 3,271,614 | 9/1966 | Scott | 315/3.5 |
| 3,271,615 | 9/1966 | Washburn, Jr. | 315/3.5 |
| 3,308,399 | 3/1967 | Drees et al. | 315/3.5 X |
| 3,374,388 | 3/1968 | Huber | 315/3.5 |
| 3,435,273 | 3/1969 | Kennedy | 315/3.5 X |
| 3,634,723 | 1/1972 | Gross | 315/3.5 |
| 3,691,630 | 9/1972 | Burgess et al. | 315/3.5 |
| 3,778,665 | 12/1973 | Harper et al. | 315/3.5 |
| 3,895,326 | 7/1975 | Hinckeldey et al. | 315/3.5 |
| 3,949,263 | 4/1976 | Harper | 315/3.5 |

*Primary Examiner*—Saxfield Chatmon, Jr.

*Attorney, Agent, or Firm*—R. S. Sciascia; P. C. Lall; A. P. Durigon

[57] ABSTRACT

A slow wave guiding structure such as a helix delay line for electron interaction devices of the traveling wave type having diamond heat sink supports for substantial enhancement of power levels of operation is provided. The diamond supported helix structures are maintained in good thermal contact by pressure only in lieu of the diamonds being bonded to metallic members. The invention is applicable to numerous slow wave structures including ladder, ring-bar, meander, as well as interdigital types.

11 Claims, 15 Drawing Figures

DIAMOND SUPPORTED HELIX ASSEMBLY AND METHOD

This invention concerns slow wave structures for traveling wave type electron interaction devices and, more particularly, the use of diamonds in such structures.

At any normal operating temperature, the diamond is far superior to any other dielectric for thermal conductivity. Because of the use of the diamond as a heat sink for semiconductors and other industrial uses, there are many shapes and sizes available commercially at relatively reasonable cost for applications such as a helix support material and heat sink in traveling wave tubes. Previous uses of diamonds for this purpose have involved metalizing the diamond and brazing it to the metal parts of the traveling wave tube using gold and silver brazing solders. A major problem with all of these systems has been that of confining the metalizing only to the surface to which it is desired to braze since it is necessary to have the diamond act as an electrical insulator. In addition, there are several known methods for bonding directly to unmetalized diamonds using active metal alloys. Experimental assemblies also have been made using such a process, and this method seems simpler for fabrication of diamond support helix assemblies. Since these procedures are tedious and costly, it would be beneficial if a simpler, less costly method and means could be found to provide the desired surface contact between the helix and the diamonds in the structure. The present invention provides such a simplified diamond support helix structure in which the contact points between the helix and the diamonds depend only on pressure to give a good thermal contact.

Accordingly, it is an object of the present invention to provide an improved helix support material for traveling wave tubes.

Another object of this invention is to provide a helix support material which accomodates the use of diamonds in wire-wrap technology to provide an improved diamond supported helix structure.

A further object of this invention is to provide a helix support material for use in traveling wave tubes which accommodates diamonds as both a support material and heat sink without requiring special surface processing of the diamond or the helix surface contacting the diamond.

Other objects, advantages and novel features of the invention will become apparent from the following detailed description thereof when considered in conjunction with the accompanying drawings in which like numerals represent like parts throughout, and wherein.

The present invention, in general, concerns an improvement in compression type diamond supported helices. Contact at the points between the diamonds and the helices does not require either brazing to metalized diamonds or the use of active metal alloys to form a bond. The points between the helices and the diamonds depend only on pressure to provide a good thermal contact, with pressure being applied upon tubing sections in which the diamonds are mounted by a wire wound around the outside of the assembly under selected tension.

Figure 1:
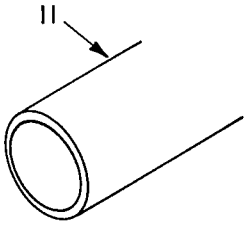
FIG. 1 is a perspective view of a tubing used in the invention and having a precision honed inside diameter.
Figure 2:
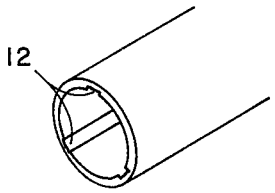
FIG. 2 is a perspective view of the tubing of FIG. 1 having grooves machined therein.
Figure 3:
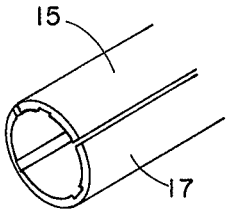
FIG. 3 shows the tubing of FIG. 2 cut longitudinally into two unequal sectors.
Figure 4:
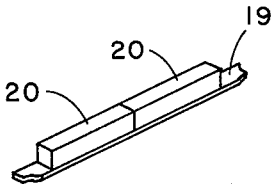
FIG. 4 is a perspective view of a prefabricated copper strip having diamond bars brazed thereon.
Figure 5:
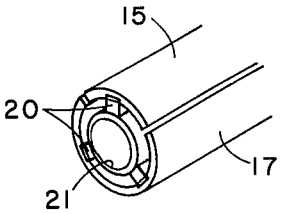
FIG. 5 illustrates the tubing sections of FIG. 3 with the diamond and copper strips of FIG. 4 positioned therein.
Figure 6:
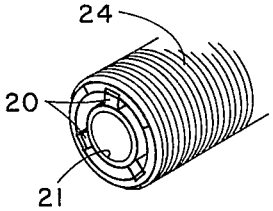
FIG. 6 shows the assembly of FIG. 5 wrapped around with wire under selected tension.
Figure 7:
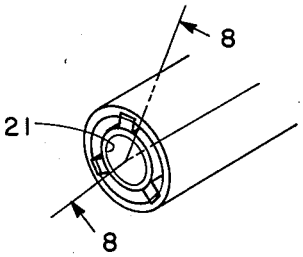
FIG. 7 shows the assembly of FIG. 6 with the wire wrapping brazed and the outer diameter machined to allow poles and magnets to be slipped thereover.
Figure 8:
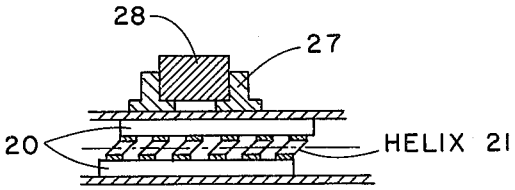
FIG. 8 is a sectional view of the assembly of FIG. 7 taken along a line substantially corresponding to line 8—8 therein and having a magnet and pole piece positioned thereabout.

Referring to the drawings, FIGS. 1–8 shows successive steps in forming the ultimate wire wrapped assembly which include a tubing 11 in FIG. 1 preferably made of molybdenum and in which a plurality of grooves 12 in FIG. 2 are machined with three grooves preferably selected to simplify the construction and yet provide a sufficient area of pressure to be exerted against the helix. In FIG. 3, tubing 11 is cut into two unequal sectors 15 and 17 covering preferably 120° and 240° of arc with grooves 12 preferably centered in sector 15 and equally spaced in sector 17 to provide uniform distribution of pressure. FIG. 4 illustrates a preferably copper tape 19 to which are attached, preferably by brazing, a plurality of diamond bars 20 which together are adapted to fit closely into grooves 12 as shown in FIG. 5 and be held therein by a helix or helix tape 21 shown as a cylinder to simplify the drawing. FIG. 6 shows a wire wrapping 24 surrounding the tubing section with the wire, preferably of tungsten, preferably having a diameter of substantially 0.004" for high strength and compactness and closely spaced so as to provide when wound under tension a pressure of several thousand pounds per square inch at each helix-to-diamond interface. In FIG. 7, the sectors are shown pressed together with wire wrapping 24 machined exteriorly to allow a plurality of pole pieces 27 preferably made of iron and magnets 28, shown in FIG. 8, to be slipped thereover. FIG. 8 shows the respective positions of the helix, diamond bars, pole pieces and magnet in and about the wire wound tubing.

Figure 9:
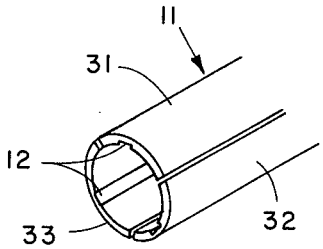
FIG. 9 is a perspective view of an alternate embodiment in which the tubing of FIG. 2 is cut longitudinally to form three equal sectors.
Figure 10:
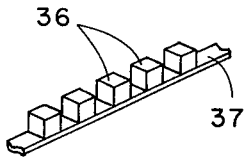
FIG. 10 is a perspective view of a copper strip having diamond cubes fastened thereon.
Figure 11:
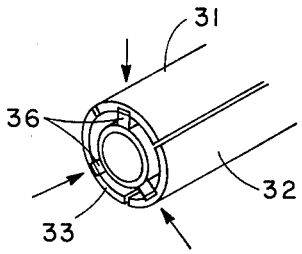
FIG. 11 illustrates the tubing sections of FIG. 9 with the diamond and copper strips of FIG. 10 positioned therein.
Figure 12:
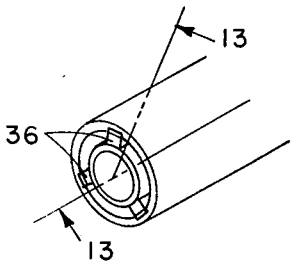
FIG. 12 shows the assembly of FIG. 11 wire wrapped as seen in FIG. 6 and with the wire wrapping brazed and machined as seen in FIG. 7.
Figure 13:
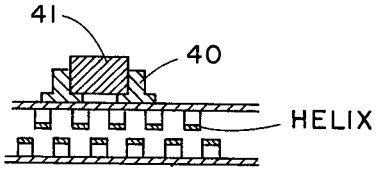
FIG. 13 is a sectional view of the assembly of FIG. 12 taken along a line substantially corresponding to line 13—13 therein and having a magnet and pole piece positioned thereabout.

FIG. 9 shows an alternate embodiment of the invention wherein tubing 11 is cut to form three equal sectors 31–33 and diamond support is provided by a plurality of diamond cubes 36 attached to a plurality of tapes 37 as shown in FIG. 10 preferably by brazing. Cubes 36 and tapes 37 are adapted to be received in close fitting relationship in grooves 12 in tubing 11 as shown in FIG. 11 and after wire wrapping as described in relation to FIG. 6 and exterior machining as stated in relation to FIG. 12 a plurality of pole pieces 40 and magnets 41 are slipped thereover as shown in section in FIG. 13.

Figure 14:
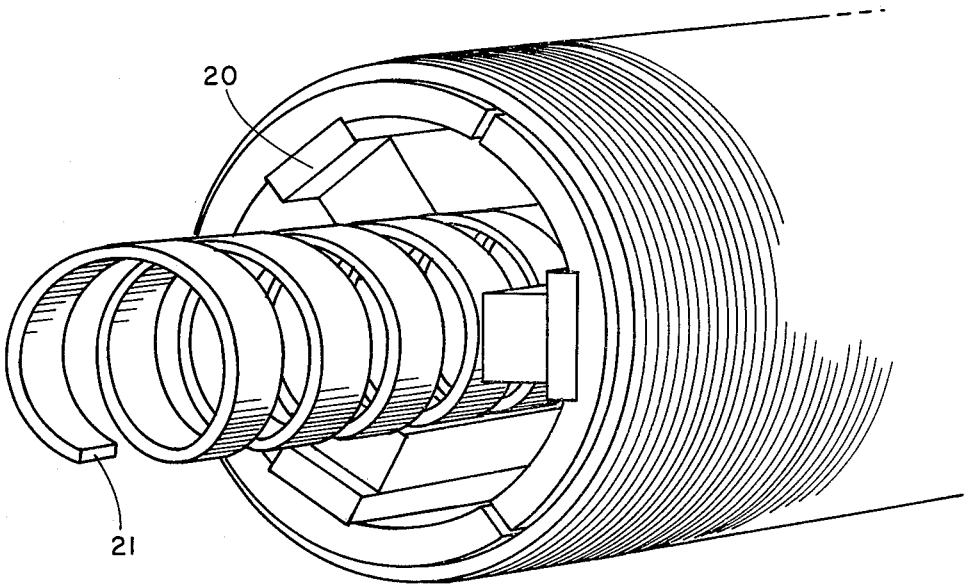
FIG. 14 is an enlarged perspective view of one end of the wire wrapped diamond supported helix assembly.
Figure 15:
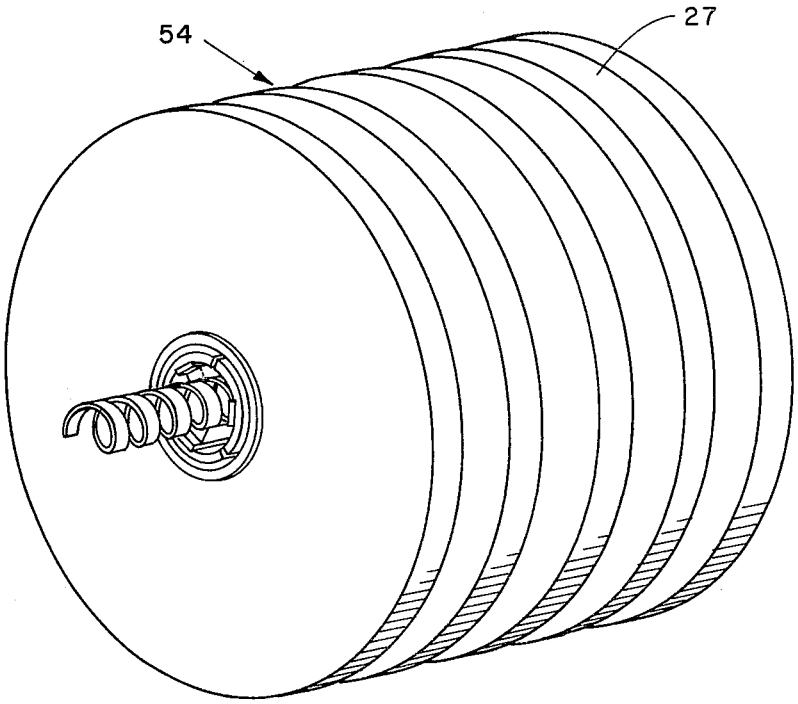
FIG. 15 is a perspective view of the diamond supported helix assembly brazed into a periodic permanent magnet (PPM) focusing structure.

FIG. 14 illustrates helix 21 which preferably is made of tungsten plated with copper supported by pressure contact within a wire-wrapped assembly by diamond bars 20 in this arrangement or cubes 36. FIG. 15 shows the diamond support helix assembly of FIG. 14 brazed into a PPM focusing structure 54 that includes pole pieces 27 but not the magnets which are inserted at final assembly between the pole pieces. The assembly is preferably brazed into the PPM structure using a gold solder in a vacuum furnace.

The improved compression type diamond supported helix of the present invention provides an assembly which has a small enough outside diameter to fit inside a PPM focusing structure. The reduced diameter is attributable to the simplified assembly process and the concept of a pressure connection only between each diamond cube or bar and the adjacent surface of the helix. The procedure of sectioning the tubing and then reforming it avoids the use of unnecessary and complex components of prior art devices. The two-piece structure of FIG. 3 is preferred since it is simpler to handle during initial assembly operations, however, either embodiment provides the desired positioning and retention pressure of the diamonds against the helix. The diamond cubes embodiment uses a much smaller amount of diamond material and provides lower dielectric loading so that it may be preferable under certain constraints. This embodiment, however, requires very careful location of the diamond cubes to ensure that each cube is directly aligned with its helix turn.

Recent improvements in diamond availability have made it possible to obtain diamond bars of suitable quality for helix supports. Such bars typically have dimensions of 0.5 mm×0.5 mm×6.0 mm and may be laid end to end on the copper strips so as to form continuous diamond helix support bars. This arrangement, as above noted, no longer makes it necessary to achieve accurate alignment of the individual diamond cubes with helix turns.

Obviously many modifications and variations of the invention are possible in the light of the foregoing teachings. For example, grooves may be formed in tubing 11 to receive four rows of diamonds and, in such an embodiment, the tubing would preferably be cut at two places only, 180° apart and midway between opposed rows of diamonds, within the inventive concept. Such an arrangement would be less difficult to handle than those shown and described while still providing the required compression when the sectors are wire wrapped. Also, where it is difficult to form a vacuum envelope by externally brazing an assembly preferably with silver-copper solder, a cylinder or barrel may be slipped over the assemblies of FIGS. 7 and 12 to provide appropriate sealing. Such a cylinder or barrel could be made of any of several non-magnetic materials such as cupro-nickel, copper, molybdenum, etc.

What is claimed is:

1. An improved structure for diamond supported helices comprising:

a metal tubing having a plurality of grooves machined therein each adapted to receive in close fit diamond heat support material in strip arrangement;

a like plurality of metal strips having diamond heat support material bonded thereto positioned in said grooves, a helix delay line having an outer diameter greater than the inner diameter of said positioned diamond heat support material, said tubing divided longitudinally into disconnected sections remote from said grooves and said sections positioned about said delay line with said diamond heat support material inner surfaces contacting the outer surface of said delay line; and wire means positioned about said disconnected tubing sections for exerting and maintaining a selected radially inward pressure against said disconnected sections;

whereby the inner surfaces of said diamond heat support material are held in thermal contact against said helix delay line without having to be bonded thereto and said pressure may be varied initially with precision by adjusting said means for exerting pressure.

2. The structure as defined in claim 1 wherein said sections and said wire are combined to form a sealed component by brazing after said structure is inserted into a PPM focusing or other structure.

3. The structure as defined in claim 1 wherein said diamond support material comprises individual members having at least two oppositely disposed parallel planar surfaces.

4. The structure as defined in claim 3 wherein said diamond members have a substantially cubical configuration.

5. The structure as defined in claim 4 wherein said tubing is divided into two sections of unequal arc and said grooves are spaced symmetrically in said sections.

6. The structure as defined in claim 3 wherein said diamond members have a bar shaped configuration.

7. The structure as defined in claim 6 wherein said tubing is divided into three equal sections and said grooves are positioned symmetrically in said sections.

8. The structure as defined in claim 7 wherein said diamond members are rectangularly shaped and abut one another to form a continuous line of support material in each of said grooves.

9. A slow wave structure for a traveling wave electron interaction device, comprising:

a compressible envelope consisting of a metallic cylinder longitudinally split into at least two disconnected segments along selected radii;

a metallic helix coaxially positioned within said compressible envelope;

a plurality of heat conducting support assemblies consisting of diamond material bonded to a metallic strip selectively positioned between and abutting said compressible envelope and said helix; and wire means selectively tensioned around said compressible envelope.

10. A slow wave structure for a traveling ware electron interaction device as recited in claim 9, wherein said segmented cyclinder is provided with a plurality of longitudinal recesses adapted to receive said heat conducting support assemblies.

11. A method of positioning helix delay lines in electron interaction devices of the traveling wave type comprising:

forming longitudinal grooves equally spaced about the interior of a cylindrical member having high thermal conductivity;

dividing said member longitudinally into at least two disconnected sections;

inserting in said grooves in close fit metallic strips having diamond support material bonded thereto;

positioning said strips over a helically wound delay line having a plurality of spaced turns so as to obtain contact between said diamond support material and said delay line opposite each of said grooves; and p1 wrapping a wire of selected small diameter about said disconnected sections so that a contact of selected pressure is created between surface portions of said delay line and said diamond support material opposite said grooves.

* * * * *